US011780668B1

(12) United States Patent
Wise

(10) Patent No.: US 11,780,668 B1
(45) Date of Patent: Oct. 10, 2023

(54) PRESSURE SYSTEM SOLUTION DISPENSER

(71) Applicant: Robert Wise, Penngrove, CA (US)

(72) Inventor: Robert Wise, Penngrove, CA (US)

( * ) Notice: Subject to any disclaimer, the term of this patent is extended or adjusted under 35 U.S.C. 154(b) by 0 days.

(21) Appl. No.: 17/368,998

(22) Filed: Jul. 7, 2021

Related U.S. Application Data

(63) Continuation-in-part of application No. 16/749,568, filed on Jan. 22, 2020, now abandoned.

(51) Int. Cl.

| | |
|---|---|
| ***B65D 83/00*** | (2006.01) |
| ***B65D 35/08*** | (2006.01) |
| ***B65D 43/16*** | (2006.01) |
| ***B65D 35/28*** | (2006.01) |

(52) U.S. Cl.
CPC ..... *B65D 83/0072* (2013.01); *B65D 35/08* (2013.01); *B65D 35/28* (2013.01); *B65D 43/167* (2013.01); *B65D 2583/005* (2013.01)

(58) Field of Classification Search
CPC ..... B65D 83/0072; B65D 43/167; B65D 2583/005; A47K 5/1202; A47K 5/1204; A47K 5/1208; A47K 5/1211
See application file for complete search history.

(56) References Cited

U.S. PATENT DOCUMENTS

| | | | | |
|---|---|---|---|---|
| 4,793,521 | A * | 12/1988 | Steiner | A47K 5/1211 222/327 |
| 5,135,646 | A * | 8/1992 | Tanokura | A61M 1/029 210/143 |
| 5,462,201 | A * | 10/1995 | Wilkins | B65D 83/0077 222/472 |
| 6,325,244 | B2 * | 12/2001 | Vincent | A23G 9/228 222/386 |
| 2002/0166875 | A1 * | 11/2002 | Sokoloff | A47K 5/14 222/192 |
| 2007/0138202 | A1 * | 6/2007 | Evers | B67D 7/0227 222/391 |

* cited by examiner

*Primary Examiner* — J C Jacyna
(74) *Attorney, Agent, or Firm* — Boudwin Intellectual Property; Daniel Boudwin

(57) ABSTRACT

A refillable solution dispenser including a dispenser housing having a base with a plurality of sidewalls defining an interior volume of the housing. A lid defining the top of the housing located on the top of the sidewalls is movably secured to allow access to the interior of the housing. An actuator mechanism is disposed through a top of the housing. At least one dispensing device is moveably connected within the housing. The dispensing device includes a pressure system connected to the actuator mechanism. The pressure system will move a pressure apparatus located within the housing forcing a solution from a solution reservoir through a dispensing passageway and out of the nozzle.

19 Claims, 4 Drawing Sheets

PRESSURE SYSTEM SOLUTION DISPENSER

CROSS-REFERENCE TO RELATED APPLICATIONS

This patent application claims the benefit of U.S. patent application Ser. No. 16/749,568, filed on Jan. 22, 2020. The above referenced patent application is herein incorporated by reference in its entirety to provide continuity of disclosure.

BACKGROUND OF THE INVENTION

The present invention relates to a dispenser solution dispenser. More particularly, the present invention provides a housing that is adapted to accept cartridges.

A large number of people use various types of soaps, shampoos, toothpastes, or other or similar substances every day. These substances often come in plastic canisters. These canisters are meant to be used once then tossed aside. While these canisters are functional and inexpensive, they also create waste.

Plastic takes decades to decompose and all the while takes space in landfills. The trash issue in our planet is starting to reach critical levels as more and more things are made to be disposable. These items can take up even more room due to the nature of haying an interior volume which may not be crushed. Due to the number of canisters used these items account for a significant amount of landfill space.

Consequently, there is a need in for an improvement in the art of solution dispensing devices that will alleviate waist. The present invention substantially diverges in design elements from the known art we at the same time solves a problem many people face when using dispensers to apply substances to a body. In this regard the present invention substantially fulfills these needs.

SUMMARY OF THE INVENTION

The present invention provides a refillable dispenser housing, wherein the same can be utilized for providing convenience for the user when dispensers to apply substances to a surface. The refillable solution dispenser is comprised of a housing having a base and a plurality of sidewalls rising therefrom defining an interior volume. The interior volume houses a dispensing device. The dispensing device is composed of a pressure plate and a pressure system. Wherein the dispensing device is connected to a first push bar, the first push bar is further connected to a second push bar. Wherein the pressure plate is moveably attached to the dispenser housing and the second push bar.

Another object of the refillable solution dispenser is to have a lid movably affixed to a top portion of the dispenser.

Another object of the refillable solution dispenser is to have a sidewall and the pressure plated shaped to fit flush together.

Another object of the refillable solution dispenser is to have a sidewall and the pressure plate compress the solution in the cartridge from the bottom upwards.

Another object of the refillable solution dispenser is to have a push knob, wherein depression of the push knob causing incremental movement of the pressure system when depressed.

Another object of the refillable solution dispenser is to have the push knob engage a pressure system such that a single push of the push knob will dispense a measured amount of solution from a solution cartridge.

Another object of the refillable solution dispenser is to have a lid locking sprocket, wherein the sprocket is operably coupled to the push nob, wherein turning the push knob will lock or unlock the lid by turning the sprocket.

Another object of the refillable solution dispenser is to have a dispensing passageway, wherein one end of the dispensing passageway is an outlet and a second end of the dispensing passageway fluidly connected to a solution cartridge.

Another object of the refillable solution dispenser is to have the push knob is connected to the pressure system using a plurality of teeth located on a side thereof.

Another object of the refillable solution dispenser is to have the dispenser is configured to accept replaceable cartridges.

Other objects, features and advantages of the present invention will become apparent from the following detailed description taken in conjunction with the accompanying drawings.

BRIEF DESCRIPTION OF THE DRAWINGS

Although characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
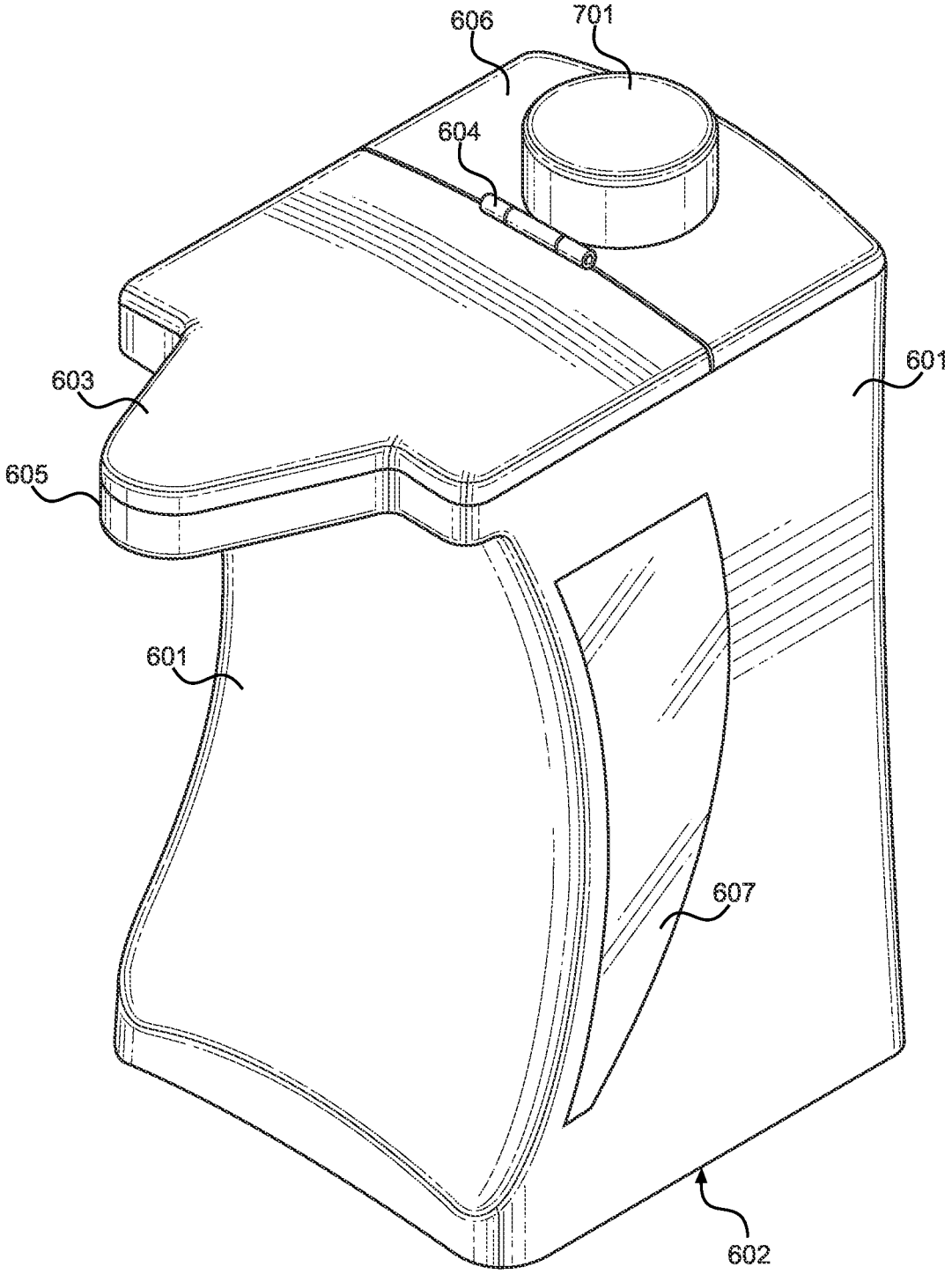
FIG. 1 shows a perspective view of an embodiment of a refillable dispenser.

Reference is made herein to the attached drawings. Like reference numerals are used throughout the drawings to depict like or similar elements of the refillable dispenser housing. For the purposes of presenting a brief and clear description of the present invention, a preferred embodiment will be discussed as used for refillable dispenser housing. The figures are intended for representative purposes only and should not be considered to be limiting in any respect.

Referring now to FIG. 1, there is shown a perspective view of an embodiment of a refillable dispenser. The refillable dispenser includes a housing comprised of a base 602 and a plurality of sidewalls 601. In one embodiment the front sidewall is a curved sidewall. In another embodiment at least one sidewall 601 has a window 607 located therein. The window 607 will show a user to see into the container and know how much of a solution is left in the cartridge. The dispenser further has a top section 606 attached to the top of at least one sidewall 601. There is a lid 603 that is movably attached to the top section and rests on at least one sidewall. Other embodiments may include multiple lids 603. This will seal off the interior when in use and still show an individual to replace a cartridge or refill the device. In one embodiment the lid is attached to the top section using a hinge 604. In one embodiment the dispenser has a front overhang 605. The front overhang 605 will show for a solution to be dispensed away from the dispenser housing. This will allow for a user to place a hand or article under the dispenser.

In one embodiment, the housing has a base with sidewalls, creating an interior volume in which to contain solutions within, such that each dispenser within the housing has a lid or common lid sealing the interior volume, and an actuator mechanism which upon deployment activates a pressure system within the housing, pressuring the solution or solutions within the interior volume, fluidly through a dispensing port of the housing. In such embodiment, each interior volume is refillable.

The top section 606 further has a push knob 701 located therethrough, or an actuator mechanism in other words. The actuator mechanism can be a push button, a knob, a lever, a trigger, or a combination thereof. The shown push knob 701 is movably disposed through an aperture of the top section 606. In one embodiment the push knob 701 is disposed within the top section 606 such that it protrudes above the plane defined by the top section 606. In one embodiment the push knob 701 is disposed through the top section 606 such that it creates a waterproof seal. In one embodiment the waterproof seal is created with a gasket. The gasket is secured to the interior of the aperture such that the knob is movably placed therein. Further, deployment of the actuator mechanism or knob increases pressure applied to a flexile solution cartridge between the pressure system and a mating sidewall within the into volume of the housing, so to dispense a solution from within the flexile solution cartridge through a dispensing port of the housing.

Figure 2:
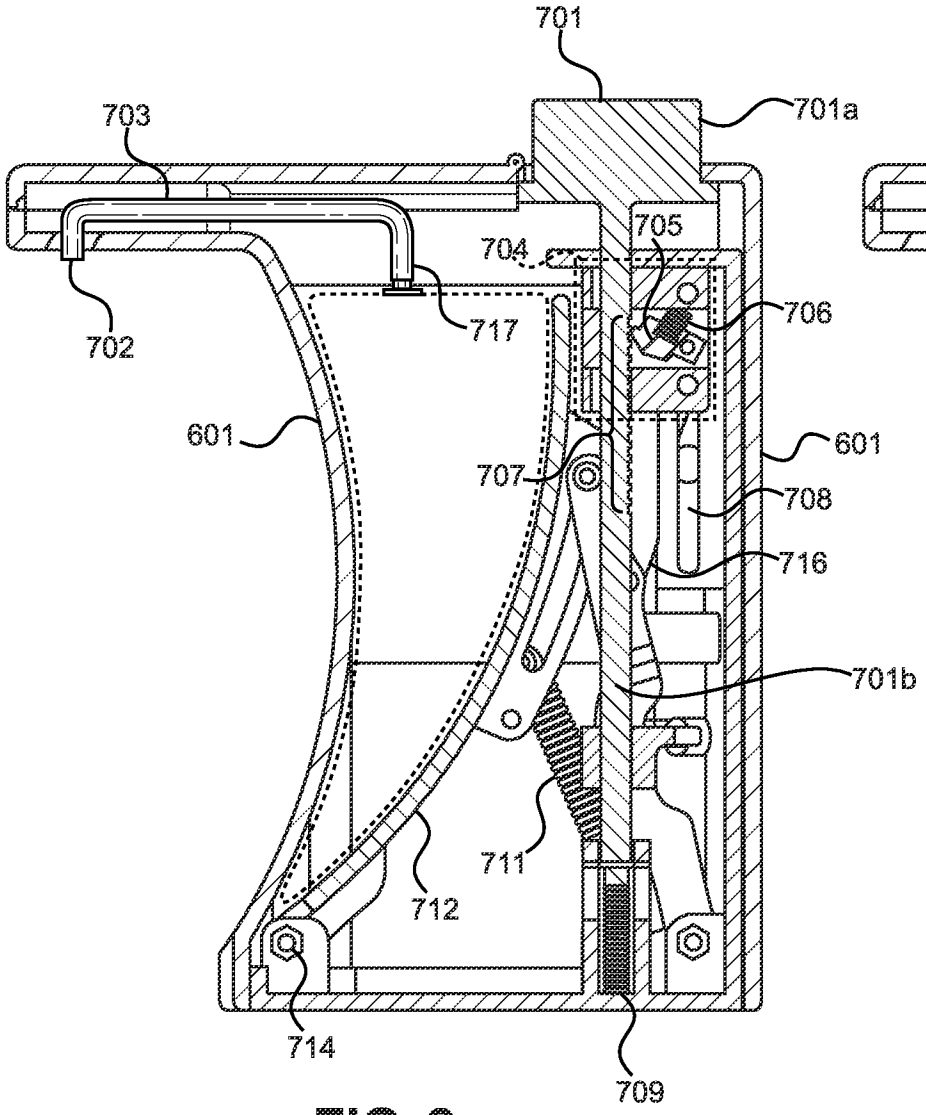
FIG. 2 shows a side cross-sectional view of an embodiment of a refillable dispenser.

Referring now to FIG. 2, there is shown a side cross-sectional view of an embodiment of a refillable dispenser. The dispenser includes a dispensing passageway 703, The dispensing passageway 703 has an outlet 702 at a first end. The second end 717 of the dispensing passageway 703 is configured to attach to a solution cartridge 715. In one embodiment, the solution cartridge 715 is flexile. In some embodiments, the flexile solution cartridge 715 includes a material selected from at least the list of Poly vinyl alcohol, butene diol vinyl alcohol co-polymer, poly vinyl succinate, organic matter, plastic, or a combination thereof. The flexile solution cartridge includes a concentrate solution within, whereby the concentrate solution may be mixed with added solvents. In one embodiment the dispensing attachment is a screw attachment. In another embodiment the attachment is female connector designed to frictionally fit over a male end connected to the solution cartridge 715. In the shown embodiment, the dispensing passageway 703 is located at within the dispenser in a top section. in one embodiment, the flexile solution cartridge 715 contains one or more compartments for multiple solutions within a single solution cartridge so to combine upon dispensing simultaneous through the housing dispenser port.

The push knob 701 has a top button 701*a* and an elongated shaft 701*b* attached to a bottom side of the top button 701*a*. The elongated shaft 701*b* has a plurality of teeth 707 located on a side thereof. The teeth 707 are configured to intermesh/interconnect to the dispensing device 704 as described below. The push knob 701 is biased in an upward position toward the top of the dispenser. In some embodiments the push knob 701 is biased using a spring 709. In one embodiment the spring is connected to the base 602 of the dispenser and the elongated shaft 701*b* of the push button 701.

The dispenser further has a pressure plate or contoured pressure apparatus 712 and a dispensing device 704. The dispensing device moves the pressure plate 712 forward forcing a solution from the solution cartridge 715. In one embodiment the solution cartridge is crushable. In another embodiment the solution cartridge is a biodegradable solution cartridge. The dispensing device includes a tooth lock 705 that is configured to interact with the teeth 707 located on the elongated shaft 701*b* of the push button. The tooth lock 705 is forced toward the teeth 707. In the shown embodiment the tooth lock is forced forward using a spring 706. The dispensing device is slidably connected to a channel 708. The channel 708 is attached to a sidewall 601.

When the push button is pushed the tooth lock 705 will be secured due to its shape and moves the dispensing device 704 downward within the channel 708. The tooth lock 705 is configured to be angled such that it will only lock to the teeth 707 in one direction, When the push knob 701 is released the tooth lock 705 will allow the teeth to slide upward relocking itself in a lower tooth. This will hold the dispensing device 704 at the new level until the push knob 701 is pressed again.

In one embodiment, the pressure plate 712 is attached to the base 602 of the dispenser, in one embodiment the pressure plate 712 is attached to the base via a hinge 714, The hinge will allow the pressure plate 712 to swing forward and backwards as described below. A spring 711 is connected to the base 602 at one end and the pressure plate 712 at a second end. The spring will bias the pressure plate 712 the backward position. This will apply a consistent pressure to the dispensing device 704. The pressure plate 712 is configured to accept a solution cartridge 715 between the pressure plate and a sidewall 601 as detailed above. In one embodiment, the actuator mechanism is moveably coupled to at least a shaft with cogs or a ratchet type assembly, whereby during each deployment of actuator mechanism, causes the cogs or ratchet type assemblies to further engage corresponding related cogs or ratchets within the housing, increasing the pressure applied to the solution cartridge upon deployment, pressing solution from within the cartridge and dispensing through the dispenser port. Some embodiments exist further comprising one or more dispensing passageways for each solution dispenser within the housing creating a dispenser port for each dispenser assembly.

Figure 3:
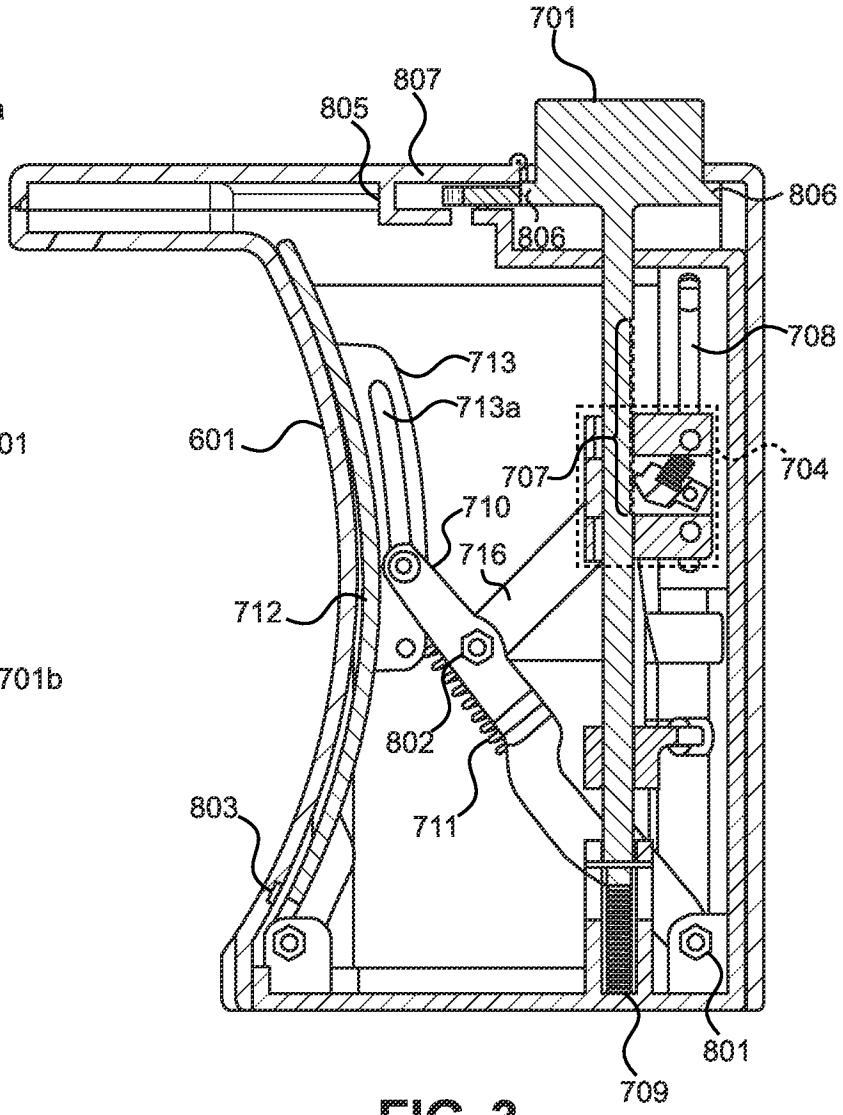
FIG. 3 shows a side cross-sectional view of an embodiment of a refillable dispenser.

Referring now to FIG. 3, there is shown a side cross-sectional view of an embodiment of a refillable dispenser with the pressure plate in a forward position. In the shown image the pressure plate 712 is in a furthest forward position. The pressure plate 712 is moved forward gradual as the dispensing device 704 is moved down the channel 708. The dispensing device 704 is connected to a first push bar 716. The first push bar is swivally connected to the dispensing device 704 at one end and a second push bar 710 at the second end. The connection at the second end is a swivel connection 802.

The second push bar 710 is attached to the base 602 of the dispenser using a swivel connection 801. This will allow the second push bar 710 to be pushed down and forward by the first push bar 716. The second push bar 710 is movably attached to a rear of the pressure plate 712. In one embodiment the pressure plate 712 has a connection section 713. In this embodiment the spring 711 is attached to the lower section of the connection section 713. The second push bar 710 is attached to a channel 713*a* of the connection section. The channel runs to the pressure plate 712.

When the push knob 701 is pressed the teeth 707 will force the dispensing device 704 down the device channel 708. The dispensing device 704 will be locked into the new position. The dispensing device 704 press the first push bar 716 down and forward. This will force the second push bar 710 down and forward as well. The second push bar 710 will move down the channel 713*a*. The second push bar 710 will also press the pressure plate 712 forward toward an opposite sidewall 601, This will force a measured amount of solution from a solution cartridge. In one embodiment the pressure plate 712 is substantially similar in shape to the is sidewall 601, in a further embodiment the interior of the sidewall opposite the pressure plate 712 has a notch 803 located therein. Many cartridges are created from tubes that have an end folded over, This fold creates a lip on the lower end of a cartridge. The notch 303 is designed to engage with a lip of a solution cartridge.

In one embodiment the push knob 701 can also function as a lid lock. The lid lock is comprised of a lid catch 807 and a sprocket 306. The sprocket 306 will have at least one elongated tooth. The elongated tooth is configured to mesh with the lid catch 807. This will prevent the lid from opening. The sprocket is configured such that the elongated tooth can be removed from the lid catch 805 when the sprocket is rotated. In one embodiment the push knob 701 has a plurality of teeth 806 therearound. The plurality of teeth is configured to mesh with the sprocket 807. When the push knob is rotated the sprocket 807 will rotate. Further, in embodiments where the push knob rotates the pressure system will be disengaged to allow the pressure plate to return to an opened position. The actuator mechanism is moveably affixed to at least a shaft coupled to a moveable sprocket activated by the actuator mechanism, wherein the sprocket secures the dispenser lid to the housing, securing the solutions within the solution dispenser.

Figure 4:
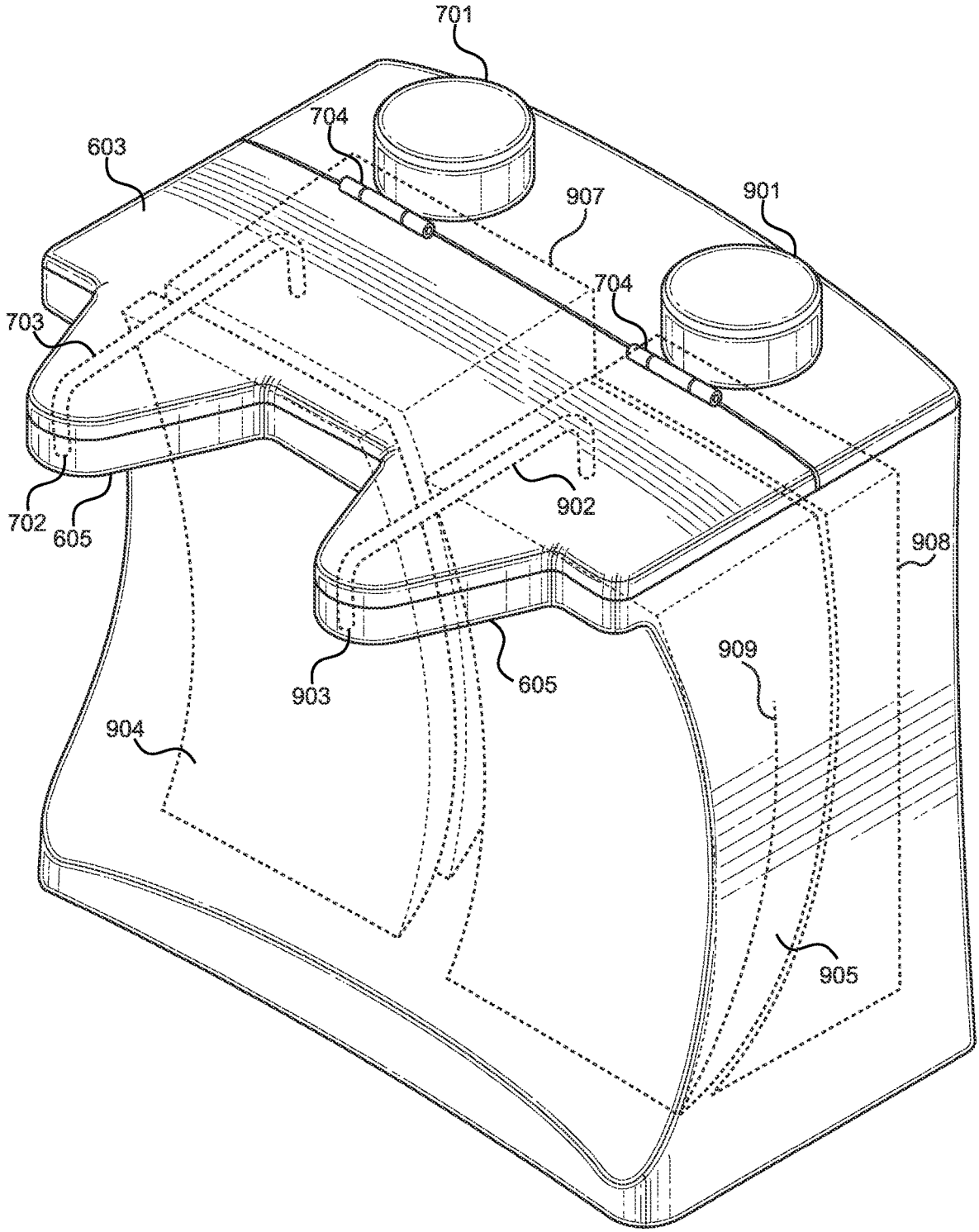
FIG. 4 shows a perspective view of an embodiment of a refillable dispenser with two dispensing devices.

Referring now to FIG. 4, there is shown a perspective view of an embodiment of a refillable dispenser with two dispensing devices. In the shown embodiment there is a larger dispenser and dispenser housing shown. The dispenser has the original or first push knob 701 and a second push knob 901. The first push knob 701 is connected to the first solution dispensing device 701 and the second push knob 901 is connected to a second solution dispensing device 908. The lid 603 is still configured to be movably attached to the top of the dispenser. In one embodiment a plurality of hinges 704 are used to connect the lid 603. In this embodiment there is a plurality of front overhangs 605, This will allow for multiple items to be dispensed.

The interior of the dispenser will have an original or first dispensing configuration as described above and a second adjacent dispensing configuration as described above. This will allow the first push knob 701 to dispense a first solution from a first solution cartridge 904 and a second solution from a second solution cartridge 905. The first solution cartridge 904 will have a first dispensing passageway 703 and a solution exit 702. The second solution cartridge 905 will have a second dispensing passageway 902 and a second solution exit 903.

In the shown embodiment the second solution cartridge 905 is shown to have a pleat 909 down the side. In one embodiment the pleat will allow the cartridge 905 to fold as it is crushed by the solution dispensing device 908. Also, in the shown embodiment the first solution cartridge 904 is shown to be crushed. The solution dispensing device 907 is shown in the forward position crushing the first solution cartridge 904. In one embodiment the solution cartridges are bio-degradable cartridges. In one embodiment, the flexile solution cartridge is composed of a material which allows the flexile solution cartridge to dissolve in water, combining into one dissolved solution. In another embodiment the flexile solution cartridge is also compostable.

Figure 5:
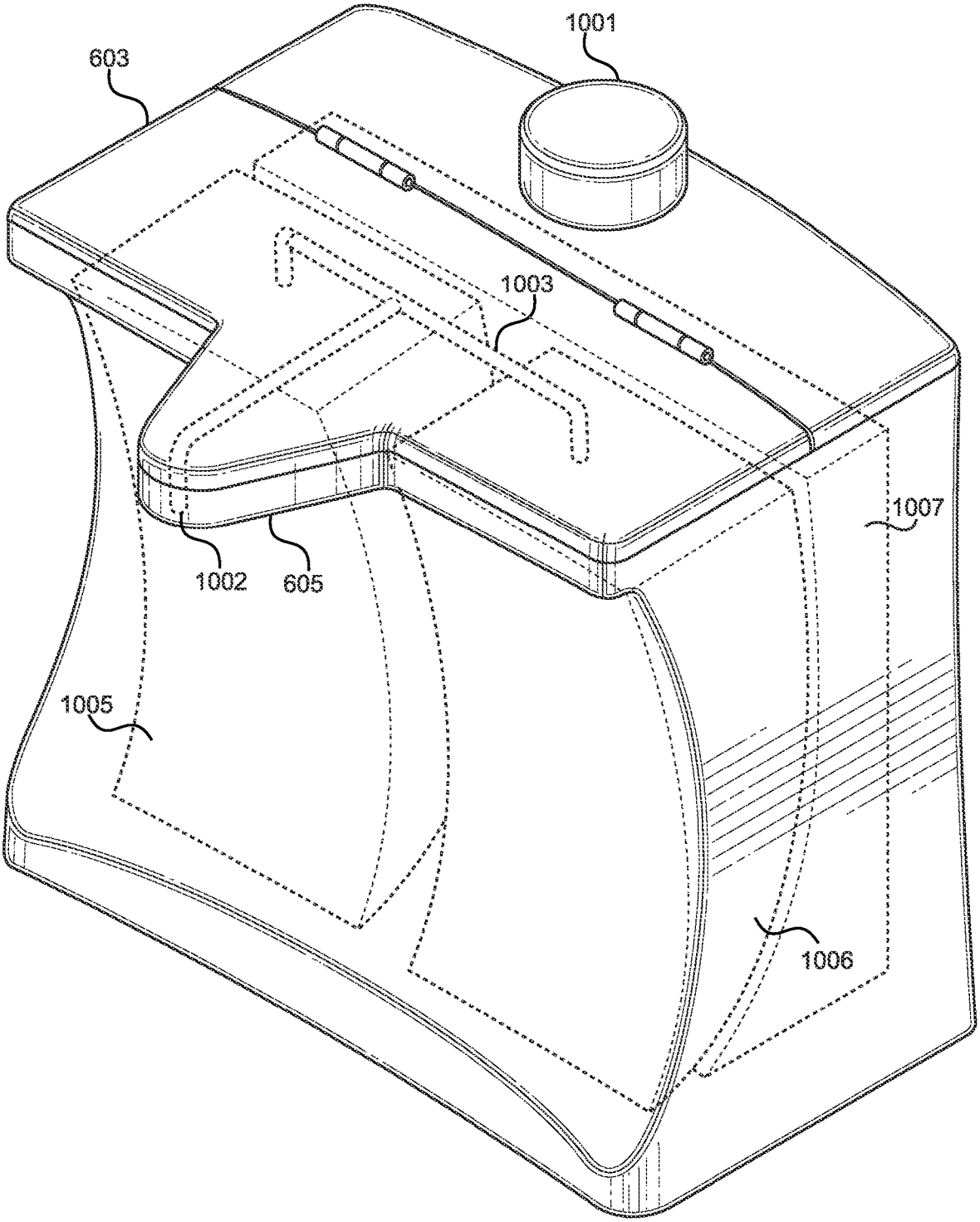
FIG. 5 shows a perspective view of an embodiment of a refillable dispenser with two dispensing devices that mix solutions before dispensing.

Referring now to FIG. 5, there is shown a perspective view of an embodiment of a refillable dispenser with two dispensing devices that mix solutions before dispensing. In a further embodiment the dispenser has two dispensing configurations each having their own solution cartridge 1005 and 1006 respectively. In this embodiment however, there is only one elongated push knob 1001. The push knob 1001 is configured to operate a single enlarged dispensing device 1007 with a single press of the push knob 1001. Further there is only one dispenser passageway 1003 and only one solution exit 1002. Both cartridges are compressed at the same time and the solutions flow together into the channel 1003. This will mix the solution in the solution passageway 1003 then dispense the solution. The housing is configured to have a lid 603 and only one front overhang 605. This will allow for a mixed solution to be dispensed through 1002.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A pressure system solution dispenser, comprising:

a housing having a base with a plurality of sidewalls rising therefrom creating an interior volume:

the interior volume houses at least one dispensing device, each dispensing device including a pressure system, wherein each pressure system is moveably attached to the interior volume of the housing;

wherein each pressure system is activated by deployment of an actuator mechanism moveably affixed to each dispensing device, wherein a deployment of the actuator mechanism increases pressure applied to a flexile solution cartridge between the pressure system and a mating sidewall within the interior volume of the housing, so to dispense a solution from within the flexile solution cartridge through a dispensing port of the housing; and wherein the actuator mechanism is moveably affixed to at least a shaft coupled to a moveable sprocket activated by the actuator mechanism, wherein the sprocket secures the dispenser lid to the housing, securing the solutions within the solution dispenser.

2. The pressure system solution dispenser of claim 1, further comprising a lid or lids movably affixed and configured to provide access to the flexile solution cartridge or cartridges within the interior volume.

3. The pressure system solution dispenser of claim 1, further comprising a contoured pressure apparatus that is moveably coupled with the pressure system within the housing.

4. The pressure system solution dispenser of claim 3, wherein the contoured pressure apparatus is configured to receive the flexile solution cartridge between the contoured pressure apparatus and the mating interior volume sidewall so to compress the solution cartridge there between.

5. The pressure system solution dispenser of claim 3, wherein the pressure apparatus compresses the flexile solution cartridge upon each deployment of the actuator mechanism of the dispensing device, into a flattened state when exhausted.

6. The pressure system solution dispenser of claim 1, whereupon deployment of the actuator mechanism of the dispensing device increases pressure the pressure system applies to the flexile solution cartridge, so to press the solution from within through the housing dispenser port.

7. The pressure system solution dispenser of claim 1, wherein the actuator is moveably connected to one or more pressure systems within the interior volume of the dispensing device, wherein a deployment of the actuator mechanism will cause to dispense solutions from more than one solution cartridge combining the solutions upon dispensation.

8. The pressure system solution dispenser of claim 6, wherein the actuator mechanism is moveably coupled to at least a shaft with cogs or a ratchet type assembly, whereby during each deployment of the actuator mechanism, causes the cogs or ratchet type assemblies to further engage corresponding related cogs or ratchets within the housing, increasing the pressure applied to the solution cartridge upon deployment, pressing solution from within the cartridge and dispensing through the dispenser port.

9. The pressure system solution dispenser of claim 6, further comprising one or more dispensing passageways for each solution dispenser within the housing creating a dispenser port for each dispenser assembly.

10. The pressure system solution dispenser of claim 9, wherein each dispensing passageway of each dispenser within the housing is in fluid communication with the dispensing passageway of each solution cartridge, so to dispense solution from within each solution cartridge through a dispensing port upon deployment of the actuator mechanism.

11. The pressure system solution dispenser of claim 1, wherein the actuator mechanism consists of at least a push button, a knob, a lever, a trigger, or a combination thereof.

12. The pressure system solution dispenser of claim 1, wherein the actuator mechanism shaft cogs or ratchet type assemblies movably uncouple from the cogs or ratchets within the housing, releasing pressure of the pressure apparatus, allowing the pressure apparatus to retract gaining access to solution cartridges.

13. The pressure system solution dispenser of claim 1, wherein the flexile solution cartridge includes a material selected from at least the list of Poly vinyl alcohol, butene diol vinyl alcohol co-polymer, poly vinyl succinate, organic matter, plastic, or a combination thereof.

14. The pressure system solution dispenser of claim 1, wherein the flexile solution cartridge includes a concentrate solution within, whereby the concentrate solution may be mixed with added solvents.

15. The pressure system solution dispenser of claim 1, wherein the flexile solution cartridge is composed of a material which allows the flexile solution cartridge to dissolve in water, potentially combining into one dissolved solution.

16. The pressure system solution dispenser of claim 1, wherein the flexile solution cartridge is composed of a material which is a biodegradable compostable material.

17. The pressure system solution dispenser of claim 1, wherein the flexile solution cartridge contains one or more compartments for multiple solutions within a single solution cartridge so to combine upon dispensing simultaneous through the housing dispenser port.

18. The pressure system solution dispenser of claim 1, wherein the housing has a base with sidewalls, creating an interior volume in which to contain solutions within, each dispenser within the housing, has a lid or common lid sealing the interior volume, an actuator mechanism which upon deployment activates a pressure system within the housing, pressuring the solution or solutions within the interior volume, fluidly through a dispensing port of the housing.

19. The pressure system solution dispenser of claim 18, wherein each interior volume is refillable with a fluid solution.

* * * * *